US007078985B2

(12) United States Patent
Guguen et al.

(10) Patent No.: US 7,078,985 B2
(45) Date of Patent: Jul. 18, 2006

(54) DEVICE FOR SEPARATING TRANSMISSION AND RECEPTION SIGNALS OF DIFFERENT POLARIZATIONS

(75) Inventors: Charline Guguen, Rennes (FR); Gérard Haquet, Chateaubourg (FR); Laurent Vrignon, Lucon (FR)

(73) Assignee: Thomas Licensing, Boulogne (FR)

( * ) Notice: Subject to any disclaimer, the term of this patent is extended or adjusted under 35 U.S.C. 154(b) by 0 days.

(21) Appl. No.: 10/450,370

(22) PCT Filed: Dec. 4, 2001

(86) PCT No.: PCT/EP01/14161

§ 371 (c)(1),
(2), (4) Date: Nov. 5, 2003

(87) PCT Pub. No.: WO02/49144

PCT Pub. Date: Jun. 20, 2002

(65) Prior Publication Data

US 2004/0100414 A1 May 27, 2004

(30) Foreign Application Priority Data

Dec. 14, 2000 (FR) ..... 00 16281

(51) Int. Cl.
*H01P 1/161* (2006.01)

(52) U.S. Cl. ..... 333/135; 333/21 A

(58) Field of Classification Search ..... 333/21 A, 333/126, 129, 135
See application file for complete search history.

(56) References Cited

U.S. PATENT DOCUMENTS 4,516,089 A * 5/1985 Goscianski et al. ..... 333/135
6,154,181 A * 11/2000 Hu-Guo et al. ..... 343/772

FOREIGN PATENT DOCUMENTS

| | | |
|---|---|---|
| EP | 928040 | 7/1999 |
| JP | 59-19401 | 1/1984 |
| JP | 6-252609 | 9/1994 |

OTHER PUBLICATIONS

Patent Abstracts of Japan, vol. 018, No. 646, Dec. 8, 1994 & JP 6-252609.
Patent Abstracts of Japan, vol. 8, No. 103, May 15, 1984 & JP 59-019401.

* cited by examiner

*Primary Examiner*—Benny Lee
(74) *Attorney, Agent, or Firm*—Joseph J. Laks; Robert D. Shedd; Brian J. Cromarty

(57) ABSTRACT

The invention proposes a transmitting/receiving device comprising at least one transition zone which comprises a means of transforming a polarized wave of a first polarization into an electrical signal; a second means of transforming an electrical signal into a polarized wave of the second polarization; and a first filtering zone placed between the antenna and the transition zone, the first filtering zone comprising a waveguide filter polarized in the second polarization direction, the said filter being transparent in the first polarization direction.

6 Claims, 1 Drawing Sheet

DEVICE FOR SEPARATING TRANSMISSION AND RECEPTION SIGNALS OF DIFFERENT POLARIZATIONS

This application claims the benefit, under 35 U.S.C.§365 of International Application PCT/EP01/14161, filed Dec. 4, 2001, which was published in accordance with PCT Article 21(2) on Jun. 20, 2002 in English and which claims the benefit of French patent application No. 00162818, filed Dec. 14, 2000.

BACKGROUND OF THE INVENTION

1. Field of the Invention

The invention relates to a device for separating transmission and reception signals and, more particularly, for transmissions in the millimetre-wave range using cross polarization.

2. Description of the Related Art

In the field of transmission signals, it is known to use systems employing waves polarized in directions which are different for transmission and reception. The use of mutually perpendicular polarization for transmission and reception, also called cross polarization, makes it possible to improve the separation of the transmission and reception signals when the frequency bands are very close.

Conventionally signals are separated with a duplexer which comprises an orthomode transducer in the waveguide, which separates the signals according to their polarization, and waveguide filters placed on the outputs of the orthomode transducer in order to produce high rejection outside the filtered band. When the transmission frequencies correspond to the millimeter frequencies, for example 40 GHz, the waveguide parts are considerably smaller in size and require expensive precision machining. The cost of machining a small orthomode transducer does not allow a mass-market product to be produced.

Other solutions can be envisaged, and U.S. Pat. No. 5,374,938 presents orthomode transducers, the outputs of which are transition probes. These orthomode transducers do not allow high rejection filtering since the filtering is carried out in microstrip technology.

Patent Application EP 0 961 339 discloses a solution in which the probes are separated by a waveguide filter, the transmission filtering being carried out in microstrip technology and the reception filtering being carried out with the waveguide filter.

However, these two solutions do not enable a transmitted signal quality which is comparable to the conventional solution using two separate waveguide paths to be obtained.

The invention proposes a solution making it possible to obtain a high transmitted signal quality without using an orthomode transducer in a waveguide. To do this, the invention adds a polarized filter between the antenna and the transition zones. The polarized filter thus enables the transmission signal to be filtered only in the transmission polarization direction in order to improve the purity of the transmitted signal. Since the polarized filter is transparent to the polarization of the received signal, the received signal is not affected by this added filter.

The invention is a transmitting/receiving device placed after an antenna, the device comprising at least one transition zone which comprises a first means of transforming at least one polarized wave of a first polarization into at least one electrical signal; a second means of transforming at least one electrical signal into at least one polarized wave of the second polarization; and a first filtering zone placed between the antenna and the transition zone, the first filtering zone comprising a waveguide filter polarized in the second polarization direction, the said filter being transparent in the first polarization direction.

According to the preferred embodiment, the first means is a first waveguide zone comprising a probe. The second means is a second waveguide zone comprising a probe. The device comprises a second filtering zone placed between the first and the second waveguide zone. The waveguides are circular. The filter of the first filtering zone is a filter with metal inserts. The filter of the second filtering zone is a filter with circular irises.

BRIEF DESCRIPTION OF THE DRAWINGS

The invention will be better understood, and other features and advantages will becomes apparent, on reading the following description, the description referring to the appended drawings, in which.

DESCRIPTION OF THE PREFERRED EMBODIMENT

Figure 1:
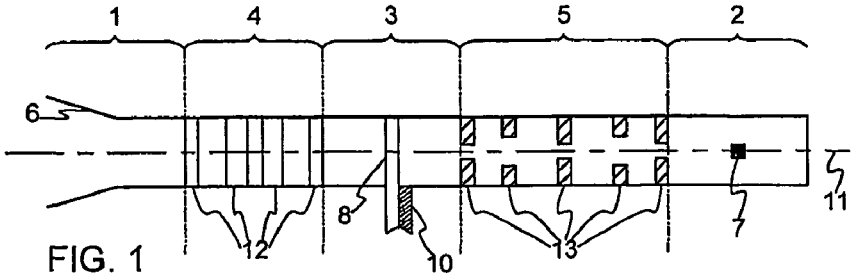
FIGS. 1 and 2 show different views of the same preferred embodiment of the invention.
Figure 2:
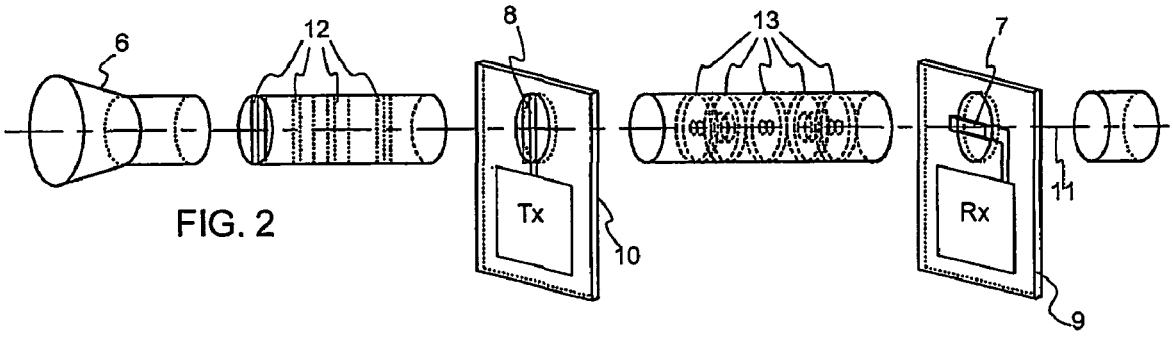

FIG. 1 is the view in longitudinal section of the waveguide element of a transmitting/receiving device. FIG. 2 is this same waveguide element in exploded view, revealing the microwave card using microstrip technology. These two figures will be described together for a better understanding. Moreover, for reasons of representation, some elements are not drawn to scale. By way of example, the reception band is between 40.55 and 41.5 GHz and the transmission band is between 42.45 and 42.5 GHz. In this example, the diameter of the waveguide is about equal to 4.8 mm, which corresponds to the low frequency of the guide.

As shown in FIG. 1, the waveguide element comprises five functional parts: an antenna 1, a first and a second transition zone 2 and 3, and a first and a second filtering zone 4 and 5. The antenna 1 is, for example, a horn 6 facing a lens or a reflector (not shown) which concentrates the electromagnetic wave according to a technique well known to the person skilled in the art.

The first and second transition zones 2 and 3 are waveguides traversed by conductors 7 and 8. The first transition zone 2 is closed off at $\lambda/4$ from one end in order to produce an open circuit in the plane of the conductor 7. The conductors 7 and 8 are, for example, made on a metal layer of a substrate 9 or 10, on which the receiving microwave circuit Rx or the transmitting microwave circuit Tx is made as best shown in FIG. 2, the conductors 7 and 8 providing the probe function. In practice, the transition zones 2 and 3 are made in two parts which fit tightly round the substrates 7 and 8, respectively, of the receiving and transmitting microwave cards. The conductors 7 and 8, made on the metal layer of the substrate, are perpendicular to the central axis 11 of the waveguide but are at the same time positioned in mutually perpendicular planes; Thus positioned, the conductors 7 and 8 operate with waves which are polarized perpendicularly one with respect to the other. The length of the transition zones 2 and 3 is such that the conductors 7 and 8 are separated from the filtering elements by at least half the mean wavelength traversing the zones 2 and 3.

In our preferred embodiment, the conductor 7 of the first transition zone 2 transforms a polarized wave of a first polarization into electrical current which will then be processed by the receiving circuit Rx so that it can be brought to an intermediate frequency in the GHz range and be transmitted via a coaxial cable to an internal unit. The conductor 8 of the second transition zone 3 transforms an electrical signal coming from the transmission circuit Tx into a polarized wave of a second polarization, the second polarization being perpendicular to the first polarization. The polarized wave is then transmitted to the antenna.

The first filtering zone 4 comprises a filter polarized with the second polarity. Such a filter is, for example, produced using of metal inserts 12 traversing the waveguide parallel to the filtered polarization direction. The widths of the inserts 12 and the spaces between the inserts 12 are calculated so as to produce a bandpass filter passing only the frequencies of the transmission band. The first filtering zone 4 is placed between the antenna and the transition zone 3 in order to improve the transmission signal-to-noise ratio.

The second filtering zone 5 is placed between the two transition zones 2 and 3, and comprises a filter passing only the frequencies of the reception band. In our preferred embodiment, the filter of the second filtering zone is, for example, a filter with cavities coupled by circular irises 13.

As regards the dimensions of the filters, the person skilled in the art can refer to the book entitled "*Microwave filters, impedance-matching networks, and coupling structures*" by George L. Matthaei, Leo Young and E. M. T. Jones, published by Artech House Books in 1980.

A wave received by the antenna which will firstly traverse the first filtering zone 4 then the second filtering zone 5. On traversing the first filtering zone 4, the waves of the second polarization will be strongly attenuated except for those waves whose frequency is that of the transmission band. The second filtering zone 5 strongly attenuates all the signals which are not those of the reception band. Inside the first transition zone, the only waves which are not attenuated are polarized waves of the first polarization which belong to the reception band. These waves are then transformed into an electrical signal by the conductor 7.

The signals to be transmitted are transformed into a polarized wave of the second polarization by the conductor 8. The filter of the second filtering zone 5 stops the transmitted waves. The filter of the first filtering zone passes the waves of the transmission band and strongly attenuates the waves outside the transmission band. The first filtering zone makes it possible to filter the transmission with an attenuation which is much greater than if the filter were made using microstrip technology.

Variants of the invention can easily be envisaged. Our example shows a waveguide of circular cross section. The use of a waveguide of square cross section enables a similar result to be obtained.

In addition, the filters as best shown in FIG. 2 may be replaced by filters of a different type provided that the final filtering characteristics are similar. The filter of the second filtering zone could be of another type. This is because it is quite possible to use a filter which attenuates the first polarization which is outside the reception band, and which stops all or part of the second polarization. A filter made using rectangular waveguide makes it possible to filter the first polarization while completely removing frequencies of the second polarization.

The invention claimed is:

1. A transmitting/receiving device placed after an antenna, the device comprising:

at least one transition zone which comprises a first means for transforming at least one polarized wave of a first polarization into at least one electrical signal; and a second means for transforming at least one electrical signal into at least one polarized wave of a second polarization;

a first filtering zone placed between the antenna and the at least one transition zone comprising the second means, the first filtering zone comprising a waveguide filter polarized in the direction of the second polarization, said filter being transparent in the direction of the first polarization direction.

2. The device of claim 1, wherein the at least one transition zone comprises:

a first waveguide zone comprising a probe for transforming said at least one polarized wave of the first polarization into said at least one electrical signal;

a second waveguide zone comprising a probe for transforming said at least one electrical signal into said at least one polarized wave of the second polarization, the second zone being placed between the first waveguide zone and the first filtering zone.

3. The device of claim 1, in which the polarized waves of the first polarization are placed in a reception frequency band and the polarized waves of the second polarization are placed in a transmission frequency band, wherein the filter of the first filtering zone passes the waves of the transmission frequency band with the second polarisation.

4. The device of claim 3, wherein the filter of the first filtering zone is a filter with a metal insert.

5. The device of claim 1, in which the at least one polarized waves of the first polarization are placed in a reception frequency band and the at least one polarized waves of the second polarization are placed in a transmission frequency band, wherein the at least one transition zone comprises a first waveguide zone comprising a probe for transforming said at least one polarized wave of a first polarization into said at least one electrical signal, and a second waveguide zone comprising a probe for transforming said at least one electrical signal into said at least one polarized wave of the second polarization, the second waveguide zone being placed between the first waveguide zone and the first filtering zone, wherein a second filtering zone is placed between the first and the second waveguide zone, the second filtering zone comprising a filter which passes only the waves of the reception frequency band, and wherein the filter of the first filtering zone passes the waves of the transmission frequency band with the second polarization.

6. The device of claim 5, wherein the first and second waveguide zones comprise waveguide elements which are circular and in that the filter of the second filtering zone is a filter with a circular iris.

* * * * *